US008991057B2

(12) United States Patent
Jaynes

(10) Patent No.: US 8,991,057 B2
(45) Date of Patent: Mar. 31, 2015

(54) SHRINK WRAP REMOVAL TOOL

(75) Inventor: Robert Jaynes, Mars, PA (US)

(73) Assignee: Aesynt Incorporated, Cranberry, PA (US)

( * ) Notice: Subject to any disclaimer, the term of this patent is extended or adjusted under 35 U.S.C. 154(b) by 304 days.

(21) Appl. No.: 13/050,321

(22) Filed: Mar. 17, 2011

(65) Prior Publication Data

US 2012/0233862 A1 Sep. 20, 2012

(51) Int. Cl.
*B67B 7/00* (2006.01)
*B67B 7/46* (2006.01)

(52) U.S. Cl.
CPC ..... *B67B 7/30* (2013.01)
USPC ..... 30/1.5; 81/3.4

(58) Field of Classification Search
USPC ..... 30/1.5; 81/3.07–3.49
See application file for complete search history.

(56) References Cited

U.S. PATENT DOCUMENTS

| | | | | |
|---|---|---|---|---|
| 999,668 | A * | 8/1911 | Montaperto | 30/102 |
| 1,376,395 | A * | 5/1921 | Boker | 81/3.4 |
| 2,674,911 | A * | 4/1954 | Theis | 81/3.44 |
| 3,263,535 | A * | 8/1966 | Zurcher | 81/302 |
| 4,845,844 | A | 7/1989 | Allen | |
| 6,477,775 | B2 * | 11/2002 | Scribner et al. | 30/1.5 |
| 6,886,253 | B2 | 5/2005 | Chan | |
| 7,069,815 | B1 * | 7/2006 | Yu | 81/3.4 |
| 7,886,446 | B2 * | 2/2011 | Yu Chen | 30/175 |
| 2005/0229750 | A1 * | 10/2005 | Duke | 81/3.4 |
| 2009/0151513 | A1 * | 6/2009 | Gross | 81/3.55 |

* cited by examiner

*Primary Examiner* — Stephen Choi
(74) *Attorney, Agent, or Firm* — Alston & Bird LLP

(57) ABSTRACT

A tool for removing shrink wrap from a product may include a first abrasive surface, a second abrasive surface, and a pressing surface, where the first and second abrasive surfaces are movable with respect to one another between an engaged position and a disengaged position, and where in the engaged position, the pressing surface presses the product into engagement with the first abrasive surface and the second abrasive surface. The first abrasive surface and the second abrasive surface may be located on a first arm and a second arm respectively. The first abrasive surface may be stationary relative to the first arm and the second abrasive surface may be stationary with respect to the second arm. The pressing surface may include a pressing element which is rotatable around an axis.

11 Claims, 10 Drawing Sheets

SHRINK WRAP REMOVAL TOOL

TECHNOLOGICAL FIELD

Embodiments of the present invention relate to shrink wrap removal tools or foil cutter tools configured to cut or tear the protective foil, plastic, or other protective material that surrounds at least the opening or closure portion of a container, and, more particularly, to a shrink wrap removal tool that does not pose safety risks for a user.

BACKGROUND

Shrink wrap or foil wrap, made of a variety of possible materials such as plastics or metal foils, may be used to surround the end of a container through which the contents of the container are accessed. The shrink wrap used to surround an end of the container, or possibly the entire container, may be present to provide evidence of tampering, may be used as a sealing mechanism, and/or may be used as part of a label, among other possible uses. The shrink wrap may be used for decorative cover of the end of a bottle such as a wine bottle, protecting a cork disposed therein from contaminants or damage. Shrink wrap may also be used to cover the end of a medicine bottle or beverage bottle to provide evidence of tampering, which may indicate that the contents of the container or bottle have been compromised or altered. Shrink wrap may also be used to encircle the tops of medicine vials intended for access by syringe needles through which medicine from the container is drawn. The shrink wrap may serve to maintain sterility of the medicine vial top while also providing evidence of tampering or of prior access of the contents of the vial. The shrink wrap may conform to the geometry of the container very well and require destruction of the shrink wrap to gain access to the vial contents.

Shrink wrap removal tools, also known as "foil cutters," are designed to compromise the integrity of a plastic or foil seal that is typically formed over the end of a container to allow a user to remove the shrink wrap and access the contents of the container. The shrink wrap may include perforations or raised areas (e.g., a tear-tab) that provide a user a weakened portion of the shrink wrap which may easily be torn by hand to remove the shrink wrap. However, the perforations or raised areas may not be sufficient for tool-free removal of the shrink wrap, and further, the perforations may compromise an otherwise sterile seal that the shrink wrap may provide to the lid or cap of the container that it surrounds.

BRIEF SUMMARY

Various embodiments of the present invention are directed to shrink wrap removal tools that are configured to compromise the integrity of a shrink wrap seal and allow a user to remove the shrink wrap seal.

A tool for removing shrink wrap from a product according to one embodiment of the present invention may include a first abrasive surface, a second abrasive surface, and a pressing surface, where the first and second abrasive surfaces are movable with respect to one another between an engaged position and a disengaged position, and where in the engaged position, the pressing surface presses the product into engagement with the first abrasive surface and the second abrasive surface. The first abrasive surface and the second abrasive surface may be located on a first arm and a second arm respectively. The first abrasive surface may be stationary relative to the first arm and the second abrasive surface may be stationary with respect to the second arm. The pressing surface may include a pressing element which is rotatable around an axis. The first arm and the second arm may be pivotable with respect to one another about the axis. The first arm and the second arm may be biased toward an engaged position by a biasing member, where the biasing member may include a torsion spring. The pressing surface may engage the product and the pressing element may rotate in a direction opposite of the product when the product is rotated relative to the tool. The pressing surface and the product may cooperate to pinch the shrink wrap therebetween and the rotation of the product relative to the tool and the pressing surface may cause the shrink wrap to rotate with the product. The first and second abrasive surfaces may include a rounded profile and a thickness of between about 0.020 inches and 0.100 inches.

Another example embodiment according to the present invention may include a tool for removing shrink wrap from a product, where the tool includes a first surface, a second surface, and a third surface, where the first surface, second surface, and third surface are arranged in a triangle and where at least one dimension of the triangle is variable between an engaged position and a disengaged position, where at least one of the first surface, second surface, and third surface is an abrasive surface, and where at least one of the first surface, second surface, and third surface that is not an abrasive surface comprises a pressure applying surface. The at least one abrasive surface may include a Coated Abrasive Manufacturers Institute Grit designation of between about 100 grit and 1000 grit. The at least one abrasive surface may include a thickness of between about 0.020 inches and about 0.100 inches. The at least one abrasive surface may include a rounded profile. The pressure applying surface may include a deformable surface.

A further example embodiment according to the present invention may provide a tool for removing shrink wrap from a product, where the tool includes a first pressure applying surface, a second pressure applying surface, and an abrasive surface. The first and second pressure applying surfaces may be movable with respect to one another between an engaged position and a disengaged position, where in the engaged position, the first and second pressure applying surfaces press the product into engagement with the abrasive surface. The first pressure applying surface and the second pressure applying surface may each include the peripheral surface of a wheel and each wheel may be rotatable about its axis. The abrasive surface may include a Coated Abrasive Manufacturers Institute Grit designation of between about 100 grit and 1000 grit and the abrasive surface may have a rounded profile.

BRIEF DESCRIPTION OF SEVERAL VIEWS OF THE DRAWING(S)

Reference will now be made to the accompanying drawings, which are not necessarily drawn to scale, and wherein.

DETAILED DESCRIPTION

Figure 1:
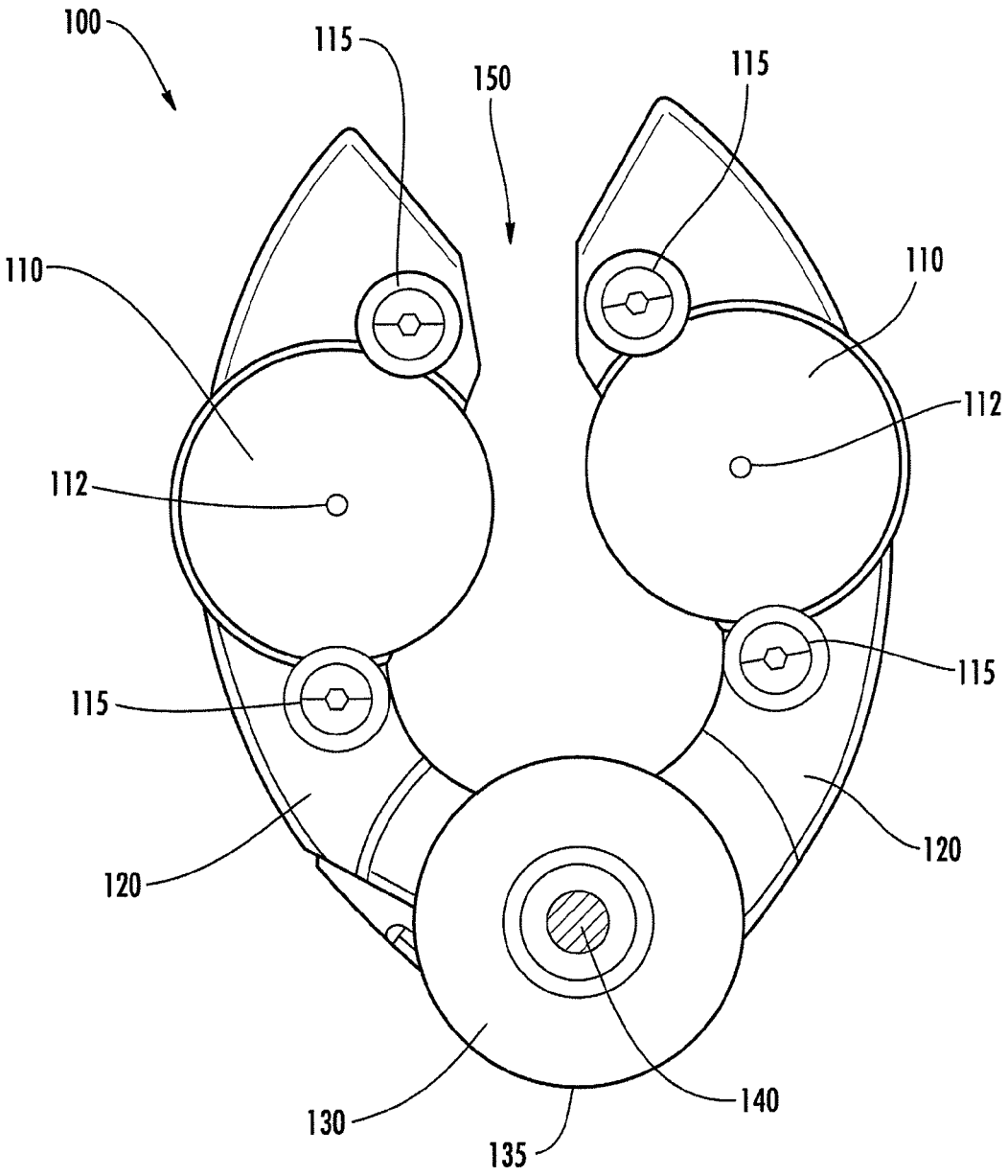
FIG. 1 illustrates a shrink wrap removal tool according to an example embodiment of the present invention.

The present invention will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. The terms top, bottom, side, up, down, upwards, downwards, vertical, horizontal, and the like as used below do not imply a required limitation in all embodiments of the present invention but rather are used herein to help describe relative direction or orientation in the example embodiments illustrated in the figures. The drawings omit illustration of certain energy absorbing materials, padding, fabric, and other coverings to facilitate ease of visibility and understanding of features of the invention.

Various embodiments of the present invention provide a shrink wrap removal tool for removing or aiding in the removal of shrink wrap from a product. Shrink wrap or other protective seals may be embodied in a number of different forms and materials and are herein referred to collectively as shrink wrap; however, the term shrink wrap is not intended to be limiting. Shrink wrap may refer to any thin film material that substantially encircles a product and substantially conforms to the shape of the product. The material may include plastics, foils, papers, adhesive backed substrates, or other materials that may serve the function of providing a tamper evident seal for a product. The material may surround only a portion of the product, or the material may surround the entire product. The shrink wrap material may be transparent, translucent, or opaque and may be printed on with product information, instructions or warnings.

Example embodiments of the present invention may be used to remove shrink wrap entirely or to compromise the seal provided by the shrink wrap to enable a user to easily remove the shrink wrap by hand after the seal has been compromised.

Shrink wrap removal tools or foil cutters have been used to cut a foil seal that is typically located proximate the open end of a bottle such as a wine bottle. The foil seal of a wine bottle may be pierced and removed by existing shrink wrap removal tools by virtue of the tool piercing the foil with a sharp blade or point and rotating the blade or point around the circumference of the foil. While this method may be effective for removal of a foil seal from a glass wine bottle, such foil cutting tools may be inappropriate for other applications for which example embodiments of the present invention may be used. Other objects, such as knives, scissors, or other sharp objects may also be used to compromise shrink wrap seals; however, such objects may not be appropriate or safe for all users or environments.

The use of sharp objects that may pierce skin or personal protective equipment (PPE) such as rubber gloves are often forbidden in areas of hospitals or pharmacies where secondary damage or contamination can occur due to an accident. For example, in clean rooms, in which operators may work with cyto-toxic drugs and other hazardous substances, sharp objects may puncture PPE worn by operators exposing the operator to dangerous chemicals and posing safety risks. Thus, sharp edges and tools are discouraged or forbidden.

Hazardous chemical and product handling has been automated in many hospitals and laboratories to reduce the potential dangers to operators; however, many of these automated devices still require the shrink wrap from a hazardous product to be removed manually by an operator. The shrink wrap of a product may include tear-aids, such as perforations or raised edges to aid operators in removing the shrink wrap by propagating a tear in the shrink wrap material. In hazardous product handing, PPE such as rubber gloves may reduce the manual dexterity of an operator such that the manual shrink wrap removal may be difficult. Additionally, the incorporation of raised edges or perforations may add cost and complexity to a manufacturing operation of the product and may degrade the sealing function of the shrink wrap. Further, tear-aids for shrink wraps may prematurely fail during shipping or routine handling providing a false indication of tampering, rending the product unusable. Manufacturing variations may further lead to ineffective tear aids further complicating manual shrink wrap removal.

Example embodiments of the present invention may provide a shrink wrap removal tool that does not use sharp blades or edges and can be used with minimal manual dexterity. Consequently, operators may be less likely to harm themselves when using the tool while safely removing the shrink wrap from a product.

FIG. 1 illustrates a shrink wrap removal tool 100 according to an example embodiment of the present invention. The depicted embodiment includes two abrasive elements 110, each attached to a respective arm 120. The arms 120 are pivotally attached to one another and pivot about axis 140. A pressing element 130 is depicted as a wheel which rotates about axis 140. The abrasive elements 110 may be removable/replaceable elements as shown comprising, for example, fiber-reinforced abrasive cut-off wheels commonly used as accessories for rotary tools. Such abrasive elements may include a surface abrasion of between about 100 Grit and 1000 Grit according to the Coated Abrasive Manufacturers Institute Grit Designation, equivalent to ISO/FEPA Grit designation of about P100 to about P2000. The depicted abrasive elements 110 may have a diameter of around one inch and a thickness of around 0.040 inches; however various thicknesses (e.g., between 0.020 and 0.100 inches) may be used. The thickness of the abrasive elements or the abrasive surfaces thereof may be of a thickness sufficient that the elements would not be considered or classified as "sharps" according to medical practice. Mosby's medical dictionary, $8^{th}$ edition, classifies "sharps" as "any needles, scalpels, or other articles that could cause wounds or punctures to personnel handling them." The abrasive elements 110 of example embodiments described herein would not cause wounds or punctures to an operator handling the abrasive element. The abrasive elements 110 illustrated may be attached to a respective arm 120 by fasteners 115. The arms 120 may further include recesses in which the abrasive elements 110 are disposed. The fasteners 115 may apply a clamping force to a surface of the abrasive elements 110 to clamp the abrasive elements 110 to a respective arm 120. The recesses within the arms 120 may help to maintain the abrasive elements 110 in position in cooperation with the clamping force applied by the fasteners 115. The abrasive elements 110 are held in a fixed position when secured by fasteners 115 such that they do not rotate about their respective central axes 112. Advantageously, removable abrasive elements 110 comprising standard components, such as a rotary tool cut-off wheel, may facilitate easy replacement of the abrasive elements should they fail through fracture or wear. Additionally, as only a portion of the abrasive element 110 is used for shrink wrap removal, as will be described further below, the abrasive elements 110 may be rotated about their axis 112 when the fasteners 115 are loosened, thereby providing a new, unused surface of the abrasive element 110 extending the useful life of the abrasive elements 110 and the shrink wrap removal tool 100.

The pressing element 130 may be made of a variety of materials; however, the peripheral surface 135 of the pressure applying element 130 is preferably of a material with a high coefficient of friction, such as a rubber or silicone, which may also allow deflection of the surface as will be further detailed below. The pressing element 130 is configured to rotate freely around axis 140. The arms 120 may also be pivotable about the same axis 140 and the arms 120 may be biased toward one another with a biasing element, such as a torsion spring.

Figure 2:
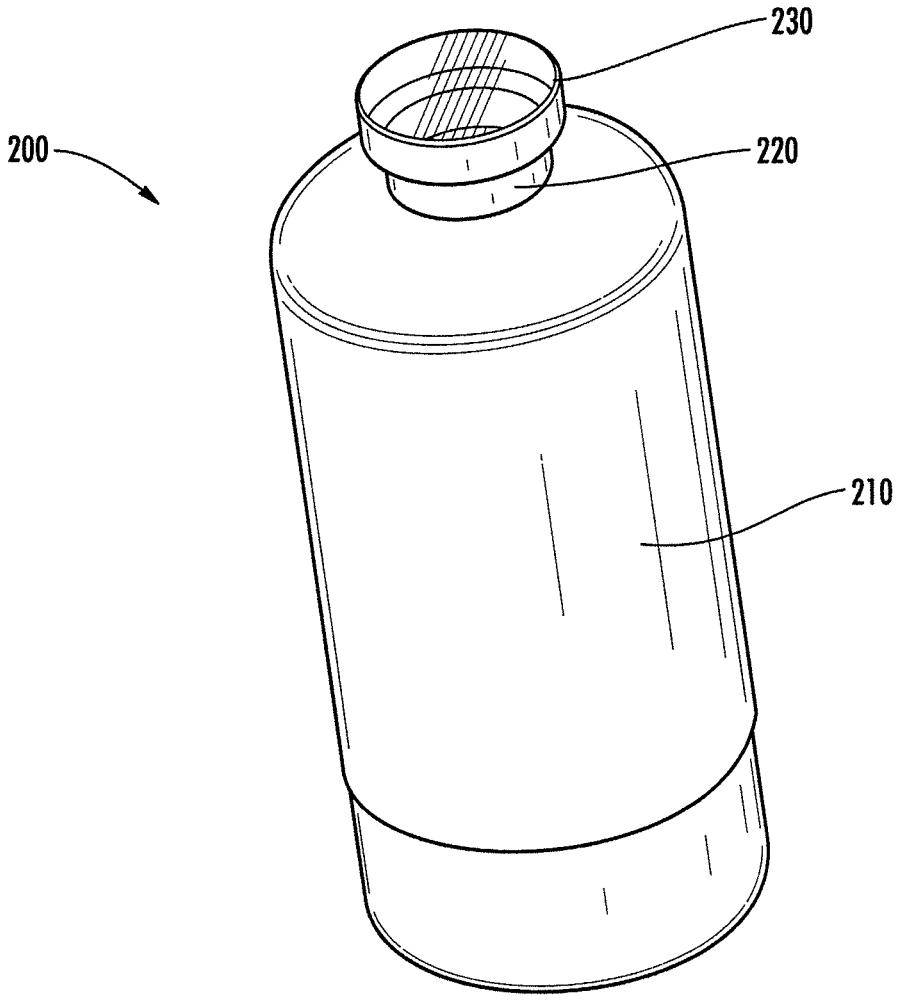
FIG. 2 illustrates a product including shrink wrap which may benefit from example embodiments of the present invention.

FIG. 2 illustrates an example embodiment of a product 200 which may be protected a shrink wrap seal. The product 200 may include a body 210, a neck portion 220, and a top portion 230. While the illustrated embodiment depicts a body 210, neck portion 220, and top portion 230 of different diameters, the diameters may be the same as one another, such as a neck portion and top portion of equal diameter. Further, the shrink wrap, not illustrated, may conform to the shape of the product 200 around the top portion 230 and neck portion 220, or around the entire product 200. While the shrink wrap is not illustrated, it is to be appreciated that the shrink wrap typically conforms to the top portion 230, neck portion 220, and/or body 210 of the product and mimics the shape of the illustrated product.

Figure 3:
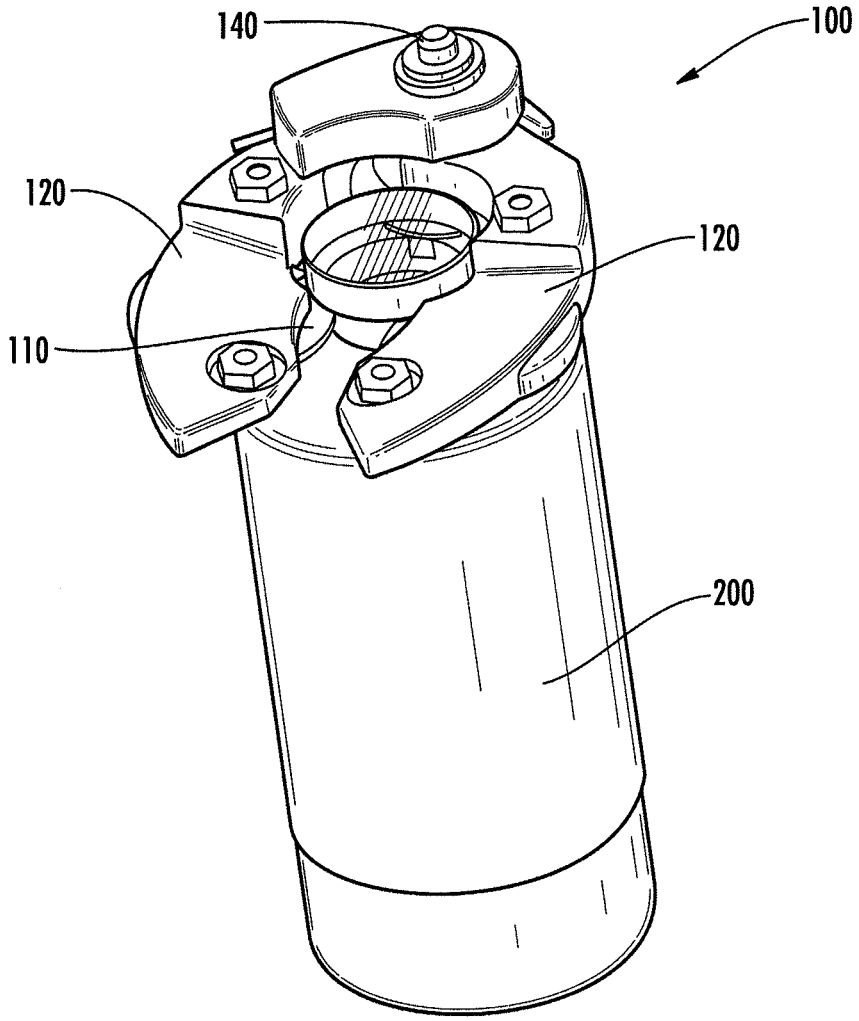
FIG. 3 illustrates a shrink wrap removal tool according to an example embodiment of the present invention as engaged with a product.
Figure 4:
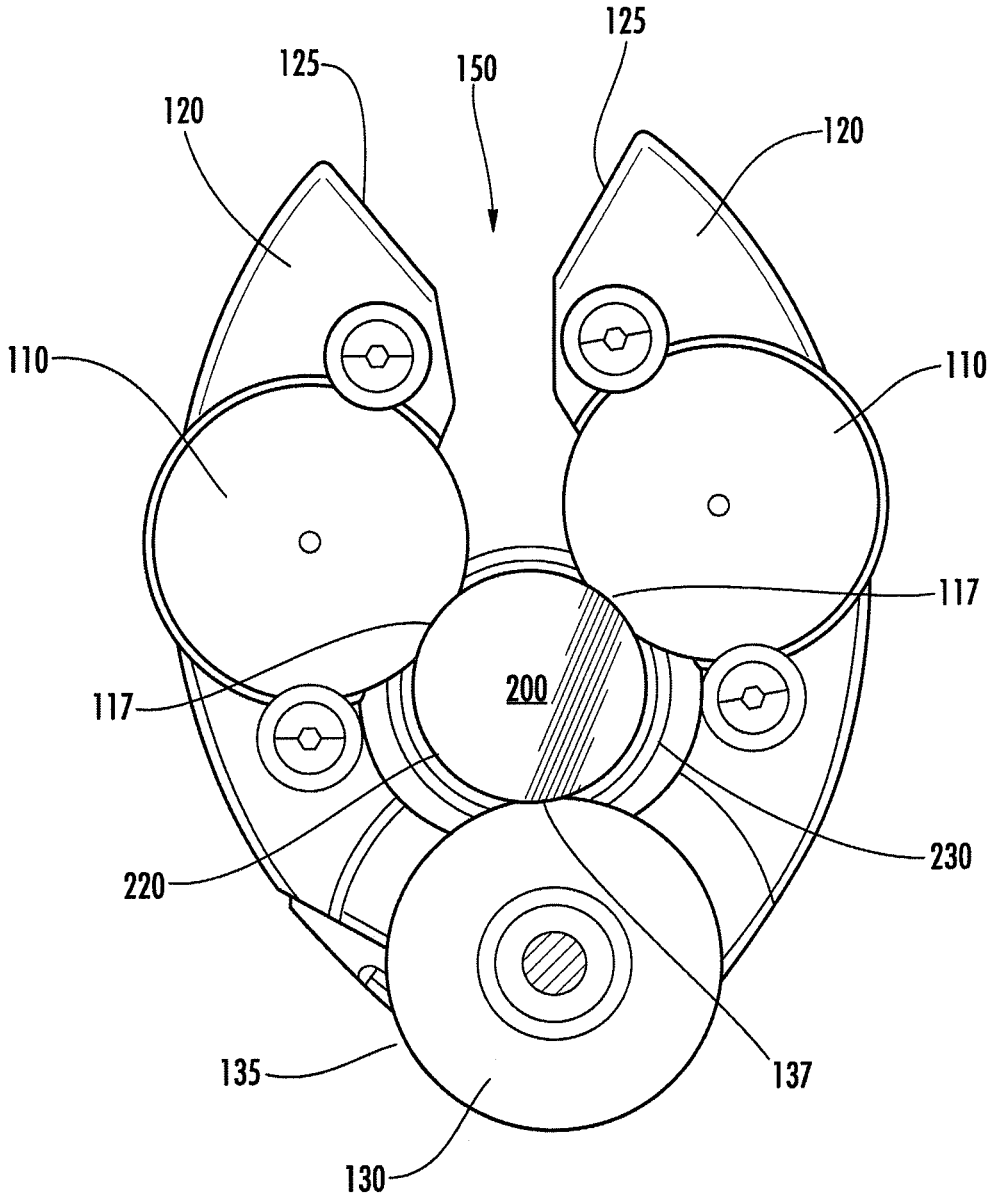
FIG. 4 depicts a section view of a shrink wrap removal tool as engaged with a product according to an example embodiment of the present invention.

FIG. 3 illustrates the shrink wrap removal tool 100 embodiment of FIG. 1 as engaged with a product 200. The depicted embodiment illustrates the abrasive elements 110 engaged with the product 200 proximate the neck portion 230. The pressing element 130 is engaged with the neck portion 230 of the product with the peripheral surface 135 pressing against the neck portion 230 of the product 200. FIG. 4 illustrates a section view of the shrink wrap removal tool 100 engaged with the product 200 as shown in FIG. 3. The section view is taken through the neck portion 220 viewing towards the top portion 230, omitting the body 210. As illustrated, each of the abrasive elements 110 are engaged along an abrasive surface 117 with the neck portion 220 of the product 200. The product 200 may be inserted into the shrink wrap removal tool 100 in one of two ways. The arms 120 of the tool 100 may open or be biased in an open position that is wide enough to accept the top portion 230 of the product between the abrasive elements 110 and the pressing element 130. Optionally, particularly if the arms 120 are biased toward one another with a biasing element, the product 200 may be inserted into the tool 100 by pressing the top portion 230 and/or neck portion 220 between the arms 120 through opening 150. The ends of the arms 120 may be configured with a bevel or curved surface 125 configured to press the arms 120 against the bias force of the biasing element as the top portion 230 or neck portion 220 of the product 200 is pressed in through opening 150.

Once the neck portion 220 of the product 200 is situated within the shrink wrap removal tool 100, the neck portion 220 may be engaged against the pressing element 130. The pressing element 130 contacts the neck portion 220 of the product along a portion 137 of the peripheral surface 135. As noted above, the shrink wrap substantially conforms to the product 200 around the top portion 230 and neck portion 220 such that when the neck portion 220 is engaged against the pressing element 130, the shrink wrap is disposed therebetween. The abrasive elements 110 are biased into engagement with the neck portion 230 with the shrink wrap disposed between the abrasive surface 117 and the neck portion 230. The abrasive elements 110 may be biased into engagement with the neck portion 230 either by a biasing element, such as a torsion spring, biasing the arms 120 toward one another, and/or with the application of force on either arm 120 pressing the arms 120 together manually, such as by the hand of an operator. Regardless of how the biasing is achieved, the pressing element 130 presses the neck portion 230 of the product 200 into engagement with a V-shape created between the two abrasive surfaces 117 of the abrasive elements 110. The neck portion 230 is then held firmly between the three surfaces (two abrasive surfaces 117 and one pressing surface 137). While the illustrated embodiment depicts two abrasive elements 110 providing two abrasive surfaces 117, embodiments may include only a single abrasive element and a single abrasive surface. In such an example embodiment where two pressing elements 130 would be pressing the neck portion 230 into engagement with a single abrasive element 110, each of the pressing elements may be rotatable about a respective central axis while the abrasive element is held rotationally fixed.

Figure 5:
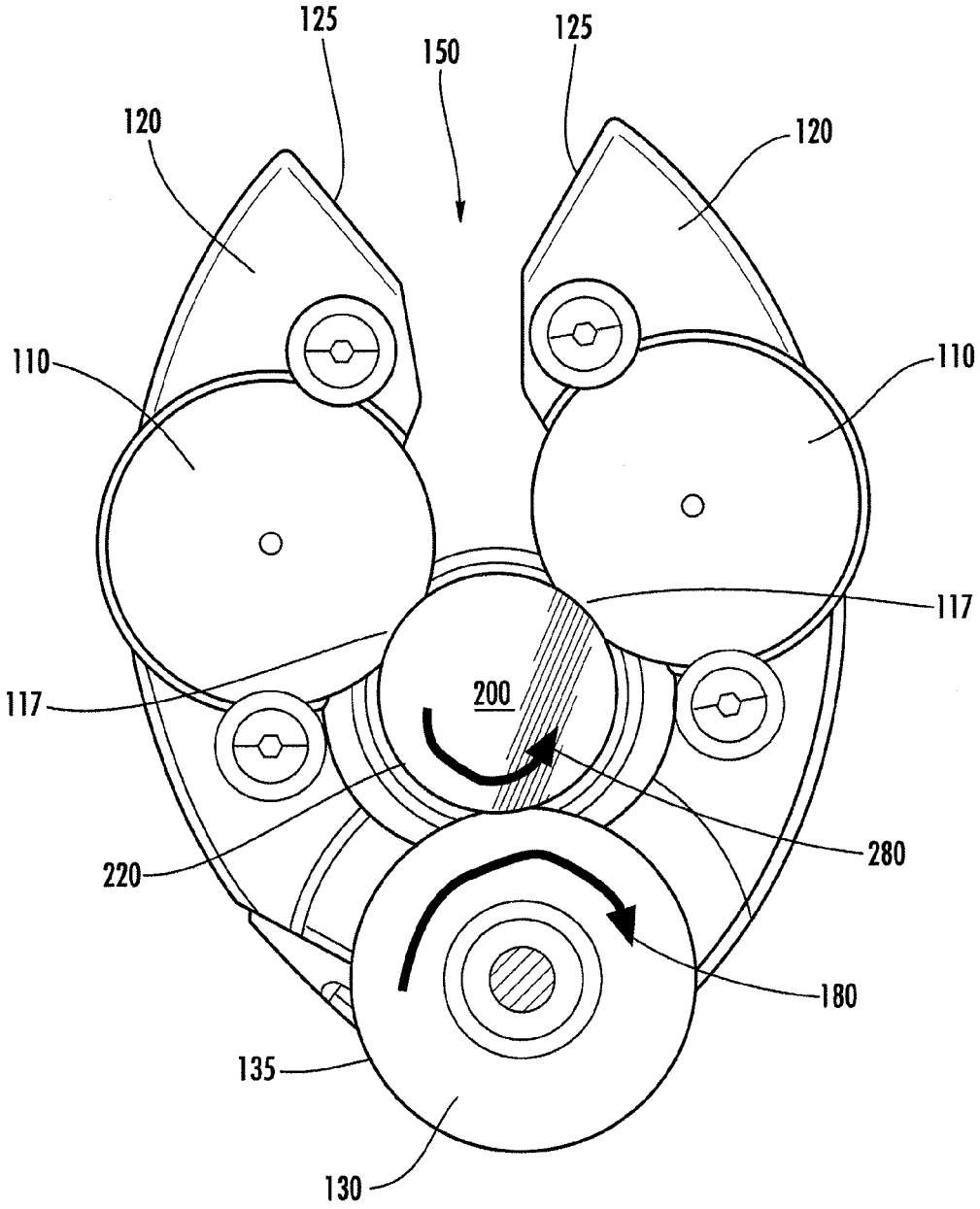
FIG. 5 depicts the section view of FIG. 4 and further includes arrows indicating the direction of motion during the use of a shrink wrap removal tool according to example embodiments of the present invention.

Example embodiments of the present invention may further include a method for removing the shrink wrap from a product. Upon the product 200 being engaged by the shrink wrap removal tool 100, an operator may rotate the shrink wrap removal tool 100 relative to the product 200 around a central axis of the product 200 by holding one of the tool 100 or product 200 fixed and rotating the other, or by rotating both the tool 100 and the product 200 in opposite directions. When the tool 100 is rotated relative to the product 200, the pressing element 130 presses against the neck portion 220 of the product and rotates in the opposite direction. FIG. 5 illustrates the rotational effects of a product 200 as it is turned along arrow 280 within the shrink wrap removal tool 100 as the pressing element 130 rotates along arrow 180 in a direction opposite of arrow 280. As the product 200 is rotated within the tool 100, the shrink wrap rotates with the product 200. As the pressing element 130 is in rotational engagement with the product 200, the pressing element maintains pressure between the shrink wrap and the product 200, thereby ensuring that the shrink wrap rotates with the product 200. Even loose fitting shrink wrap which may be able to rotate freely about the product when turned by hand will be held in fixed rotational alignment with the product by virtue of the pressing element 130 maintaining pressure between the pressing surface 137 and the neck portion 220 of the product 200, clamping the shrink wrap therebetween. Since the pressing element 130 rotates with the product 200, the product 200 and pressing element 130 serve as "rollers" feeding the shrink wrap between the two as they are rotated, maintaining the shrink wrap in rotational alignment with the product 200. The pressing element 130 includes a surface that may be somewhat deformable, such as a rubber or silicone surface, which may increase the surface contact area between the neck portion 220 of the product 200 and the pressing element 130. The increased contact area may promote rotation of the shrink wrap with the product 200 while reducing the pressure required to maintain rotational alignment between the shrink wrap and the product 200.

As the product 200 and shrink wrap attached thereto are rotated, the abrasive elements 110 are held fixed such that the product and the shrink wrap are rotated relative to the abrasive elements 110. The abrasive surface 117 of the abrasive elements 110 presses the shrink wrap against the product 200 and abrades the surface of the shrink wrap as the shrink wrap rotates with the product 200. The abrasive action of the abrasive surface 117 on the shrink wrap weakens or tears the shrink wrap.

The curved surface of the abrasive elements 110, while providing a surface that does not contain sharp, potentially dangerous surfaces for an operator, when engaged with the curved surface of the neck portion 220 of the product, create finite surface contact areas between the abrasive surface 117 and the shrink wrap encased product 200. As the abrasive elements 110 are made of a relatively hard material, they do not deform appreciably when pressure is applied between the product 200 and the abrasive elements 100. The lack of deformation maintains a finite surface contact area between the abrasive element 110 and the product 200 at the abrasive surface 117. The finite surface contact area results in a higher pressure applied at the abrasive surface 117 such that the shrink wrap which rotates by the abrasive surface is contacted with a high-pressure abrasive surface over a small area, resulting in abrasions or tears in the surface of the shrink wrap.

In an alternative embodiment, the abrasive elements may include a flexible member that may conform to the profile or surface of the product 200 when the product is engaged by the shrink wrap removal tool. Upon the product becoming engaged with the flexible member, the flexible member may partially surround a portion of the product 200 and apply a pressure at the area of contact. The flexible member at the area of contact may include an abrasive surface that engages the shrink wrap encased product.

Figure 6:
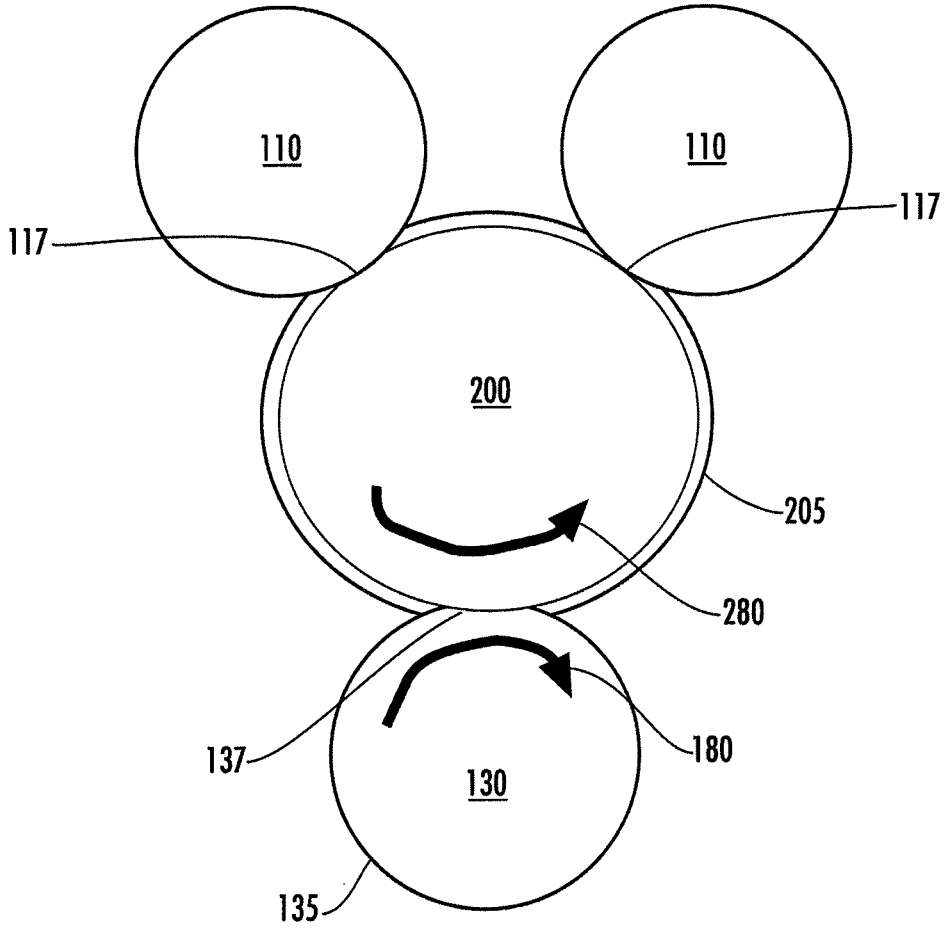
FIG. 6 illustrates the abrasive elements and the pressing element of a shrink wrap removal tool according to an example embodiment of the present invention as engaged with the shrink wrap of a product.

FIG. 6 illustrates a schematic representation of a product 200 including shrink wrap 205 which is loose fitting over the product 200 with the pressing element 130 and abrasive elements 110 illustrated engaged with the product 200 and the shrink wrap 205. The pressing element 130 may deform at the point of contact 137 with the product 130 thereby clamping the shrink wrap 205 between the pressing element 130 and the product 200. The abrasive elements 110 press the shrink wrap 205 against the product 200 at the point of the abrasive surface 117. As the product 200 is rotated in the direction of arrow 280 relative to the elements 110, 130 of the tool, the pressing element 130 rotates in the direction of arrow 180, opposite that of arrow 280, creating a pinch point at 137 that pinches, and draws through the shrink wrap 205 with the product 200, thereby rotating the product 200 and the shrink wrap 205 in unison. The peripheral surface 135 of pressing element 130 includes a relatively high friction surface and, by way of deformation and size of the pressing element, a relatively large contact area such that the pressing element 130 ensures rotation of the shrink wrap 205 with the product 200. The relatively small contact area between the abrasive elements 110 and the shrink wrap 205 and product 200 at abrasive surface 117 apply a pressure over a smaller area. The pinch and rotational effects of the pressure element 130 at pressing surface 137 is sufficient to overcome the frictional effects of the abrasive surfaces 117 against the shrink wrap 205 such that the shrink wrap 205 is rotated by, and dragged across the abrasive surface 117, resulting in an abraded area or tear in the shrink wrap 205. The product 200 is turned within the tool until the shrink wrap 205 is torn about all or most of the periphery of the product 200 to allow a user to easily remove the shrink wrap remaining on the top portion 230 of the product.

Figure 7:
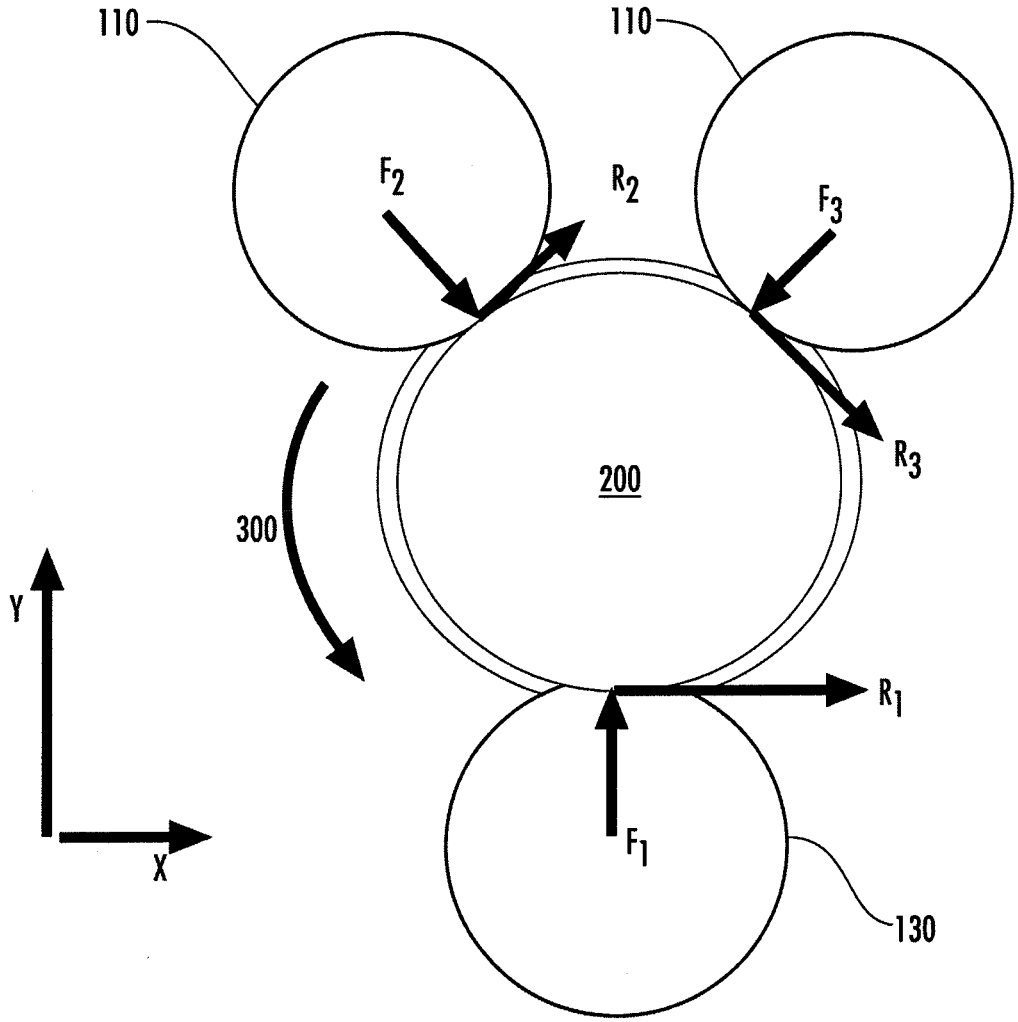
FIG. 7 illustrates a force diagram representing the forces involved during the operation of a shrink wrap removal tool according to example embodiments of the present invention.

FIG. 7 illustrates the forces exerted when the product 200 is engaged within the shrink wrap removal tool 100. $F_1$ is the force exerted on the product 200 by the pressing element 130. In the illustrated embodiment with the depicted X-Y axes, $F_1$ exerts a force only in the Y-axis. The forces $F_2$ and $F_3$ each have both an X-component and a Y-component. The X components of $F_2$ and $F_3$ cancel each other out while the Y-components of $F_2$ and $F_3$ combined are equal and opposite to that of $F_1$. The shrink wrap itself, upon shrinking to conform to the product 200 applies hoop stress "S" around the circumference of the product. After the product 200 is engaged with the shrink wrap removal tool 100, the product 200 is then turned relative to the shrink wrap removal tool 100. Upon the initiation of relative rotation, frictional forces are encountered at the contact points between the product 200 and each of the frictional elements 110 ($R_2$ and $R_3$) and between the product 200 and the pressing element 130 ($R_1$). Arrow 300 illustrates the direction that the product 200 is turned within the tool 100. $R_1$ is illustrated in the direction of the rotation as the pressing element 130 rotates with the product 200, while $R_2$ and $R_3$ are illustrated opposite the direction of rotation 300 as the friction elements 110 are stationary and resist the rotation of the product 200.

As the product 200 is rotated within the shrink wrap removal tool 100, the shrink wrap must rotate with the product 200 for the tool 100 to properly function. To that end, the hoop stress S and the frictional coefficient between the shrink wrap around the product 200 may be sufficient to hold the shrink wrap in rotational alignment with the product 200. However, if the shrink wrap is loose or the hoop stress and resultant frictional force applied by the shrink wrap to the product 200 is low, the frictional force $R_1$ between the pressing element 130 and the product 200 (combined with any hoop stress frictional force) must be greater than the combined frictional forces $R_2$ and $R_3$ between the two abrasive elements 110 and the product 200 such that the product 200 and shrink wrap rotate in unison within the tool 100.

Figure 8:
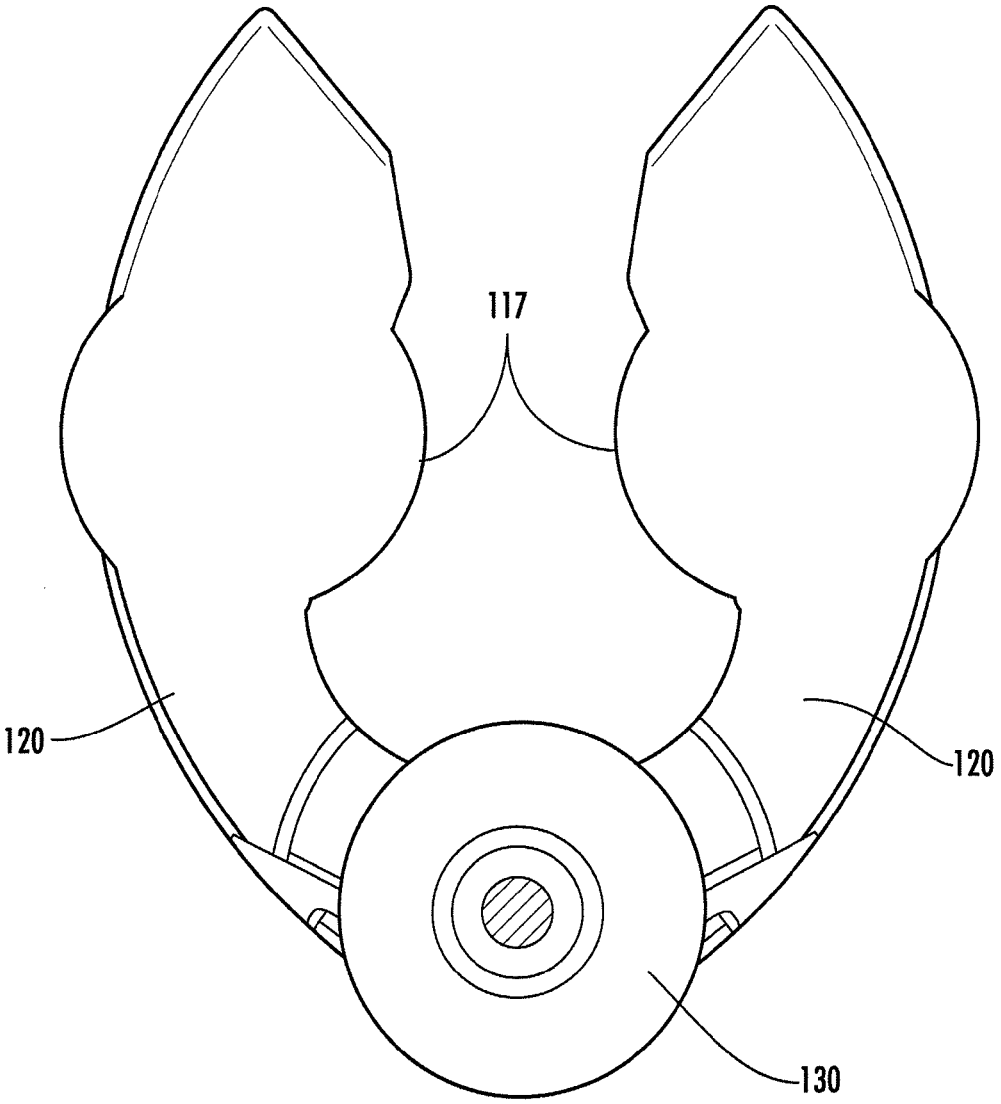
FIG. 8 illustrates a shrink wrap removal tool according to another example embodiment of the present invention.

FIG. 8 illustrates another example embodiment of the present invention wherein the abrasive surfaces 117 are not part of removable/replaceable abrasive elements, but integral to the arms 120. In such an embodiment, abrasive elements may be molded into the arms 120 or the arms may include a portion configured to be coated with an abrasive coating that would perform the same functions as the above described abrasive elements.

Example embodiments of the present invention may include abrasive surfaces 117 that are substantially co-planar and serve to tear or propagate a tear in a circle around a product 200. Optionally, the abrasive surfaces may be arranged at angles relative to one another or at a stagger with respect to one another such that the tear or tear propagation is in the form of a spiral, where the spiral tear creates a tear-tab which can be pulled by an operator to effect a spiral tearing/unwinding of the shrink wrap of the product.

Figure 9:
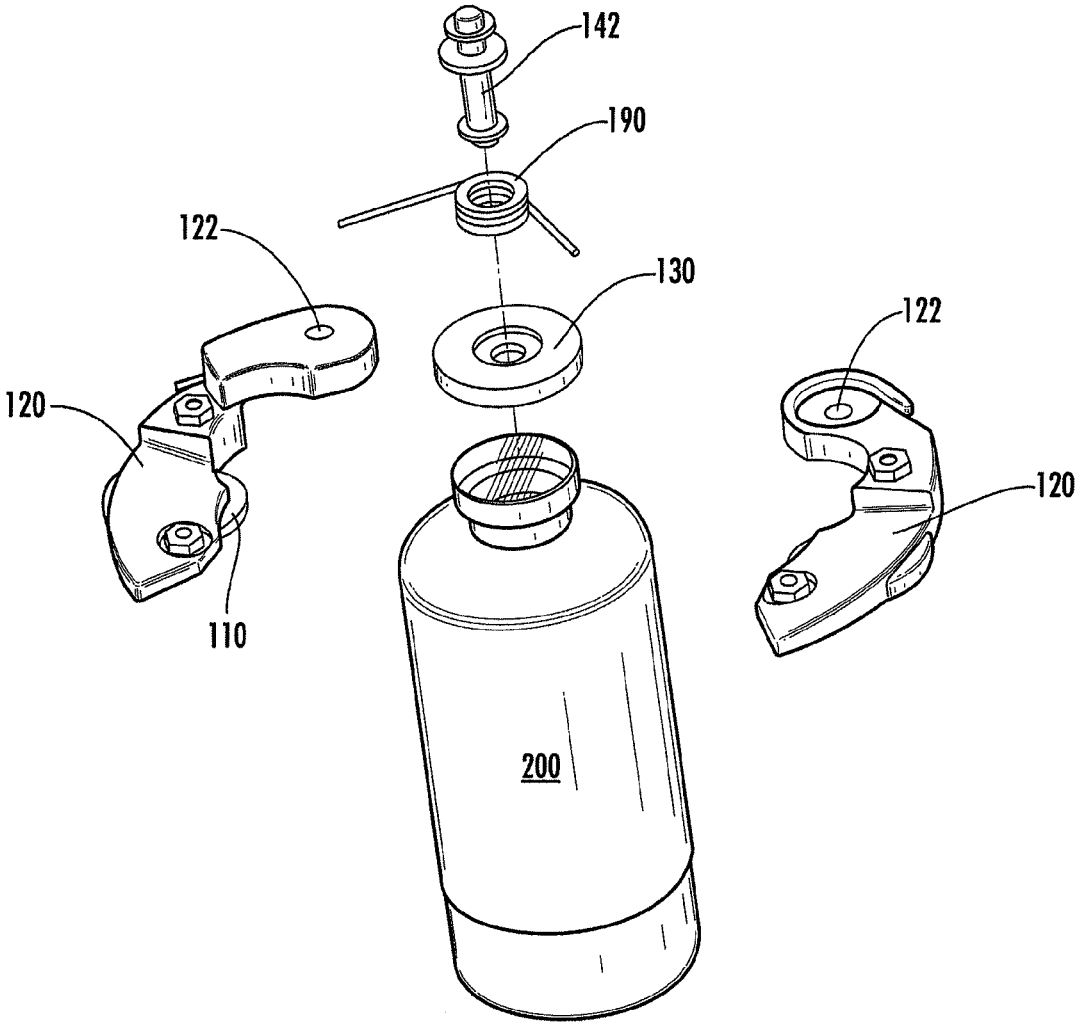
FIG. 9 depicts an exploded view of a shrink wrap removal tool according to an example embodiment of the present invention.

FIG. 9 illustrates an exploded view of an example embodiment of a shrink wrap removal tool according to example embodiments of the present invention. The illustrated embodiment depicts arms 120, each with a pivot axis comprising a hole 122. The arms 120 may be pivotally attached to one another by a pin 142 which defines the pivot axis. A biasing element 190, such as the depicted torsion spring, may be disposed between the two arms 120 with the pin 142 therethrough and the biasing element 190 may bias the arms 120 toward one another into the engaged position. Optionally, a biasing element may be configured to bias the arms apart, toward a disengaged position, such that an operator must apply pressure to both arms 120 to overcome the bias and apply further pressure to engage the abrasive elements 110 and pressing element 130 with the product 200. Such an embodiment may improve insertion and removal of the product 200 from the shrink wrap removal tool; however the act of removing the shrink wrap from the product may then require additional forces exerted by the operator other than rotation of the product relative to the tool. Example embodiments in which the bias element 190 biases the arms 120 into engagement with one another may not require any operator pressure to be exerted on the arms 120 during the removal of the shrink wrap from the product 200.

Figure 10:
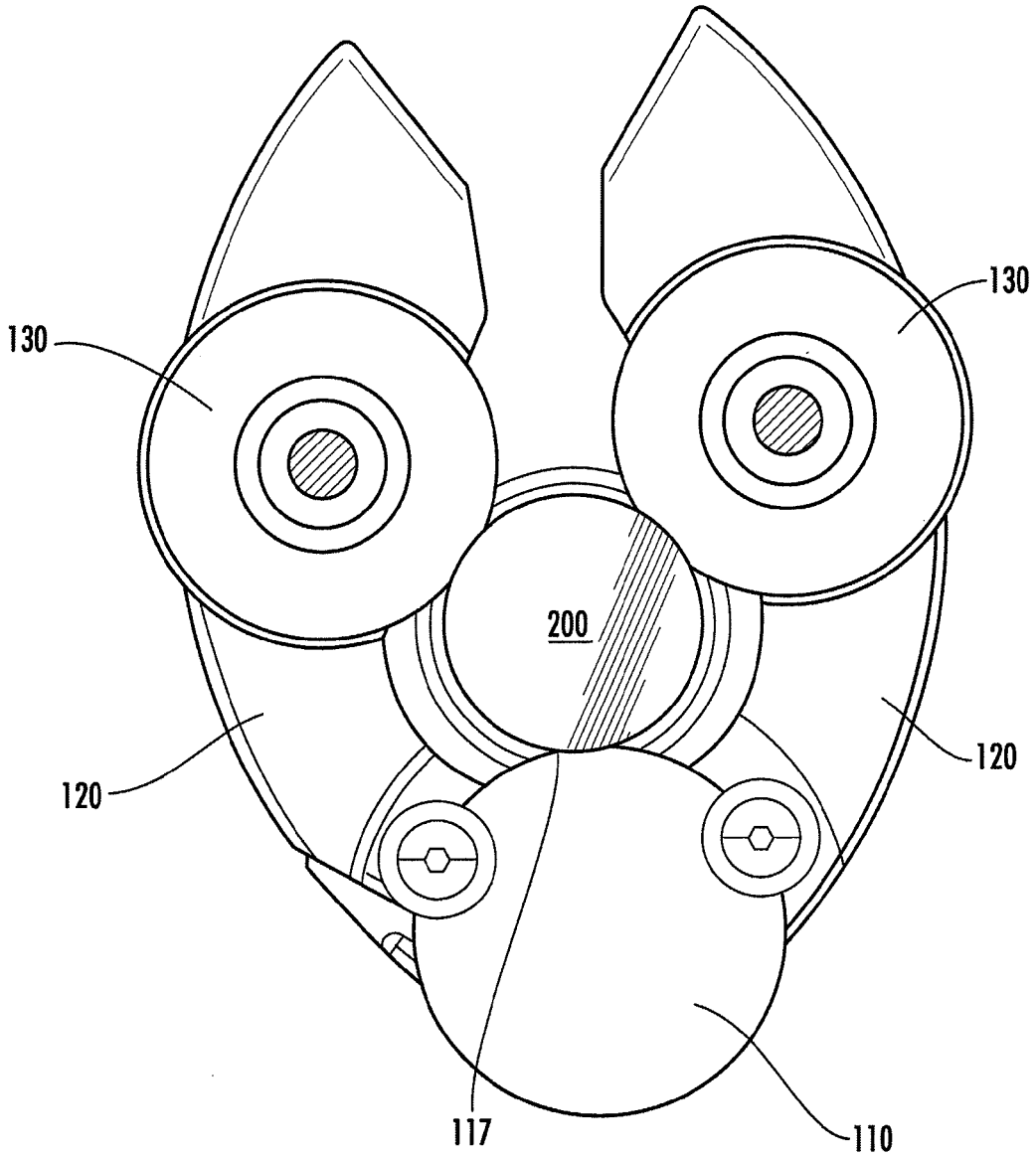
FIG. 10 depicts a shrink wrap removal tool according to another example embodiment of the present invention.

FIG. 10 illustrates another example embodiment of a shrink wrap removal tool according to the present example depicting a tool with a single abrasive element 110 and two rotating pressing elements 130. In the illustrated embodiment, each of the pressing elements is located on a respective arm 120 while the abrasive element is located at the apex of the arms 120. The function of the illustrated embodiment is substantially the same as the embodiments described above; however, with two pressing elements, the grip of the shrink wrap and the rotation of the shrink wrap with the product is enhanced while the cutting pressure applied at the abrasive surface 117 is increased.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A tool for removing shrink wrap from a product comprising:

a first arm comprising a first abrasive surface having a rounded profile;

a second arm comprising a second abrasive surface having a rounded profile, wherein the first arm is pivotably connected to the second arm at a pivot axis; and an element comprising a third cylindrical surface rotatable about the pivot axis, wherein the first surface, second surface, and third surface are arranged in a triangle, wherein the first surface, the second surface, and third surface are arranged to be engaged with the product at the same time, and wherein at least one dimension of said triangle is variable between an engaged position in which the first surface, the second surface, and the third surface are engaged with the product, and a disengaged position in which at least one of the first surface, the second surface, and the third surface is not engaged with the product, wherein the first and second surfaces are held fixed relative to the first and second arms respectively, wherein each of the first and second abrasive surfaces comprising a removable element having a thickness of between about 0.020 inches and about 0.100 inches, wherein the third surface is not an abrasive surface comprises a pressure applying surface that is rotatable about the pivot axis, and wherein the first surface, the second surface, and the third surface comprise edge profiles that would not be classified as sharps according to medical practice.

2. The tool of claim 1, wherein the at least one abrasive surface comprises a Coated Abrasive Manufacturers Institute Grit designation of between about 100 Grit and 1000 Grit.

3. The tool of claim 1, wherein when a product received between the first surface, the second surface, and the third surface and the at least one dimension of said triangle is in the engaged position, the shrink wrap surrounding the product is cut in response to relative rotation between the product and the tool.

4. A shrink wrap removal tool comprising:

a first arm comprising a first abrasive surface;

a second arm comprising a second abrasive surface, wherein the first arm and the second arm are pivotably coupled together at a pivot axis, and wherein each of the first and second abrasive surfaces includes a rounded profile and comprising a removable element having a thickness of between about 0.020 inches and 0.100 inches; and a pressing element comprising a cylindrical pressing surface, wherein the pressing surface is disposed about the pressing element, wherein the pressing element is coupled to the first arm and the second arm, and wherein the pressing element is rotatable about the pivot axis;

wherein the first abrasive surface, the second abrasive surface, and the pressing surface are arranged in a triangle and are configured to be engaged with a product comprising shrink wrap simultaneously;

wherein the first abrasive surface, the second abrasive surface, and the pressing element comprise edge profiles that would not be classified as sharps according to medical practice.

5. The shrink wrap removal tool of claim 4, wherein the first abrasive surface and the second abrasive surface are configured to be moved toward an engaged position with a product in response to the first arm and the second arm being moved toward one another.

6. The shrink wrap removal tool of claim 5, further comprising a biasing member, wherein the first arm and the second arm are biased toward the engaged position by the biasing member.

7. The shrink wrap removal tool of claim 6, wherein the biasing member comprises a torsion spring.

8. The shrink wrap removal tool of claim 5, wherein when the first and second abrasive surfaces are in the engaged position, the pressing element rotates in a direction opposite of the product in response to the product being rotated relative to the tool.

9. The shrink wrap removal tool of claim 8, wherein the pressing surface and the product cooperate to pinch the shrink wrap of the product therebetween and wherein the rotation of the product relative to the tool and the pressing surface causes the shrink wrap to rotate with the product.

10. The tool of claim 9, wherein in response to the product being rotated relative to the tool, the first and second abrasive surfaces, in the engaged position, cut the shrink wrap surrounding the product.

11. The shrink wrap removal tool of claim 4, wherein the first abrasive surface is fixed relative to the first arm and wherein the second abrasive surface is fixed relative to the second arm.

* * * * *